US005916097A

United States Patent [19]

Markuten

[11] Patent Number: 5,916,097

[45] Date of Patent: Jun. 29, 1999

[54] CHILD'S PLAY SHELTER

[76] Inventor: Richard Markuten, 133 Canal St., Darlington, Pa. 16115

[21] Appl. No.: 09/076,093

[22] Filed: May 12, 1998

[51] Int. Cl.[6] ..... E04B 1/32

[52] U.S. Cl. ..... 52/81.2; 52/79.4; 52/460

[58] Field of Search ..... 52/80.1, 81.2, 52/82, 79.4, 236.2, 460, 464; 446/476

[56] References Cited

U.S. PATENT DOCUMENTS

| | | | |
|---|---|---|---|
| 2,690,185 | 9/1954 | Pomykala | 52/81.2 |
| 3,327,874 | 6/1967 | Peterschmidt | 52/81.2 |
| 3,696,566 | 10/1972 | Langner . | |
| 3,875,709 | 4/1975 | Hall . | |
| 4,154,423 | 5/1979 | Crock . | |
| 4,663,898 | 5/1987 | Yacaboni | 52/82 |
| 5,050,354 | 9/1991 | Vendramini . | |
| 5,377,460 | 1/1995 | Hicks . | |
| 5,485,701 | 1/1996 | Hecht . | |
| 5,497,974 | 3/1996 | Tapang . | |

*Primary Examiner*—Michael Safavi
*Attorney, Agent, or Firm*—Richard C. Litman

[57] ABSTRACT

A child's play shelter having a skeletal structure composed of a plurality of arcuate beams or bowed frames connected at the top forming a rotatable ring. Arcuate combination horizontal and vertical T-bar and rib sections are interconnected as water tight snap-on elements which produce cavities for interstitial elements. A crawl-in-entrance-way is disposed in a side of the igloo with a mesh flap to close the entrance. The snap-on T-bar and rib sections are proportionately cut to form the shape of an igloo when assembled. The horizontal arcuate elements are fastened to the beams of the shelter in a staggered fashion with respect to the vertical arcuate elements to produce a structure having insertable and pop-out windows. A movable or rotating top is attached to the rotatable ring providing multiple or surrounding views above the igloo. A water drain is selectively pre-cut in each rib for draining water to the base of and away from the igloo.

10 Claims, 4 Drawing Sheets

CHILD'S PLAY SHELTER

BACKGROUND OF THE INVENTION

1. Field of the Invention

The present invention relates generally to shelters. More particularly, the invention is a child's play shelter in the form of an igloo-like or domed structure.

2. Description of the Related Art

Many igloo or dome-shaped structures have been devised for various purposes. While the purpose for these structures vary, the particular construction of most of the conventional igloo or dome structures are related to a distinct geometrical configuration, having different levels of difficulty in the methods of fastening or interconnecting the constituent elements to special panels or external coverings for aesthetic appeal. The most significant portion of these types of designs is the skeletal structure of the igloo or domed shaped structure which is often quite complex. The panels associated with conventional igloo structures, as external features, usually require complex fastening methods which require the knowledge of a skilled artisan to assemble.

For example, U.S. Pat. No. 3,696,566 issued to Langner discloses a self-supporting dome-like structure comprising pentagonal and hexagonal structures. The hexagonal structures, in particular, increase in number according to a specific mathematical formula and are mechanically secured by bolts in special relation with respect to the special geometrical shapes. These particular geometrical shapes when arranged and fastened together are suppose to prevent failure due to high stress along fold lines having geodesic alignment. The child's play shelter according to the present invention is not prone to this type of problem.

U.S. Pat. No. 3,875,709 issued to Hall discloses a panel securing means which utilize T-shaped vertical columns with insertable side wall panels. The structure resembles a circular wall having a canopy or roof connected thereto. This structure is completely different from the child's play shelter according to the instant invention as herein described.

U.S. Pat. No. 4,154,423 issued to Crock discloses an apparatus for the construction of a domed structure comprising single molds or rigid containers for retaining snow. The molds are sequentially stacked to form a domed structure. The problem with this particular structure is when the molds are filled with snow, it becomes almost impossible to manually disassemble the structure. The child's play shelter according to the instant invention is easily assembled and disassemble as herein described.

U.S. Pat. No. 5,050,354 issued to Vendramini discloses a similar structure built by the principle use of molds. A concrete cylindrical shaft is erected on a concrete floor slab to form a central stem wherein wall elements composed of a composite fibre/resin material are interconnected to form a dome or mushroom shaped structure thereabout. This particular structure is a permanent structure, and can not be disassembled as in the instant invention as herein described.

U.S. Pat. No. 5,377,460 issued to Hicks discloses a dome building without an internal support structure. The building is not capable of retaining interstitial fillers or snow to provide the igloo appearance according to the instant invention. Other U.S Patents, such as those issued to Hecht (U.S. Pat. No. 5,485,701) and Tapang (U.S. Pat. No. 5,497,974) disclose the igloo shaped construction similarly taught by the instant invention. However, these prior art constructions lack an internal support structure and a rotating assembly as is in the present invention.

The child's play shelter of the instant invention is different from the prior and related art, in that it provides a simple snap-on-rib structure which when assembled forms a lightweight, sturdy and water tight igloo structure having a rotatable top which is adjustable for multiple play settings. In this regard, none of the above inventions and patents, taken either singularly or in combination, is seen to describe the instant invention as claimed. Thus, a child's play shelter solving the aforementioned problems is desired.

SUMMARY OF THE INVENTION

The child's play shelter according to the invention has a skeletal structure composed of a plurality of arcuate beams or bowed frames connected at the top to form a rotatable ring. Arcuate horizontal and vertical T-ba and rib sections are interconnected as water tight snap-on elements which produce cavities for interstitial elements, including accumulated snow packed therein. A crawl-in-entrance-way is disposed in a side of the igloo with a mesh flap to close the entrance. The combination snap-on T-bar and rib sections are proportionately cut to form the shape of an igloo when assembled. The horizontal arcuate elements are fastened to the beams of the shelter in a staggered block fashion with respect to the vertical arcuate elements to produce a structural clearance for insertable and pop-out windows which require minimal mechanical adjustments. A movable or rotating top is attached to the rotatable ring providing multiple or surrounding views above the igloo. A water drain or trough is selectively pre-cut in each rib section for draining water to the base of and away from the igloo. Anchors are also provided at the base of the igloo to secure the igloo to a platform.

Accordingly, it is a principal object of the invention to provide a child's play shelter which simulates a snow igloo.

It is another object of the invention to provide a child's play shelter which is simple to assemble.

It is a further object of the invention to provide a child's play shelter which maintains ventilation and permit the use of accessories.

Still another object of the invention is to provide a child's play shelter having interstitial panels having a simple geometrical construction.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT(S)

The present invention is directed to a child's play shelter for simulating a snow-igloo. The igloo is adapted for multiple play settings which stimulates the interest of children. The preferred embodiment of the present invention is depicted in FIGS. 1–7, and is generally referenced by numeral 8.

Figure 1:
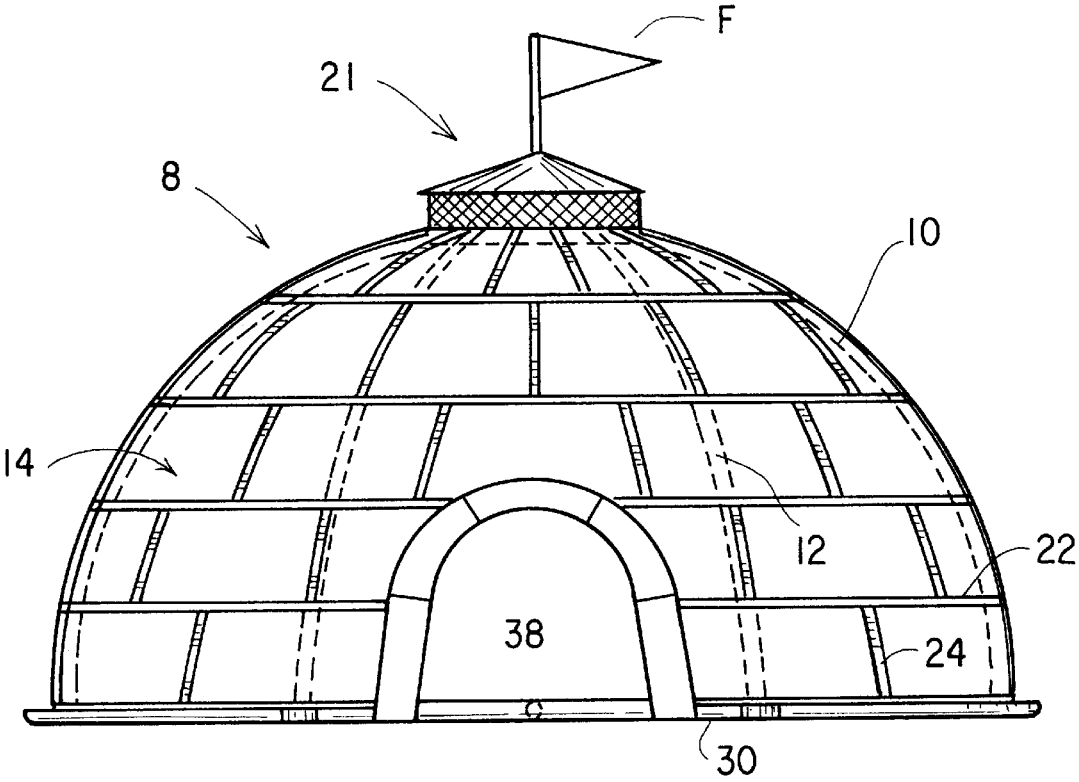
FIG. 1 is an environmental, perspective view of a child's play shelter according to the present invention.

As best seen in FIGS. 1, 2, 4 and 6, a child's play shelter 8 in the form of an igloo-like structure, comprises an interior-supporting framework 10 which is made up of a predetermined plurality of equispaced, bowed framing members 12. The bowed members 12 as illustrated in FIG. 1, by dotted lines are arranged to generally form a hemisphere, having top or upper ends 12*a* and bottom or lower ends 12*b* mechanically fastened to a retainer ring, respectively. The framework 10 provides the structural strength and safety required for an exterior, precast, arcuate waffle-like housing structure 14 which is dimensioned and configured to fit over and be supported by the framework 10. The framework 10 is preferably 9 feet in diameter and 4.5 feet high. A compromise between head room requirements and exterior igloo realism would determine the actual size and shape of the dome as a matter of personal preference.

Figure 5:
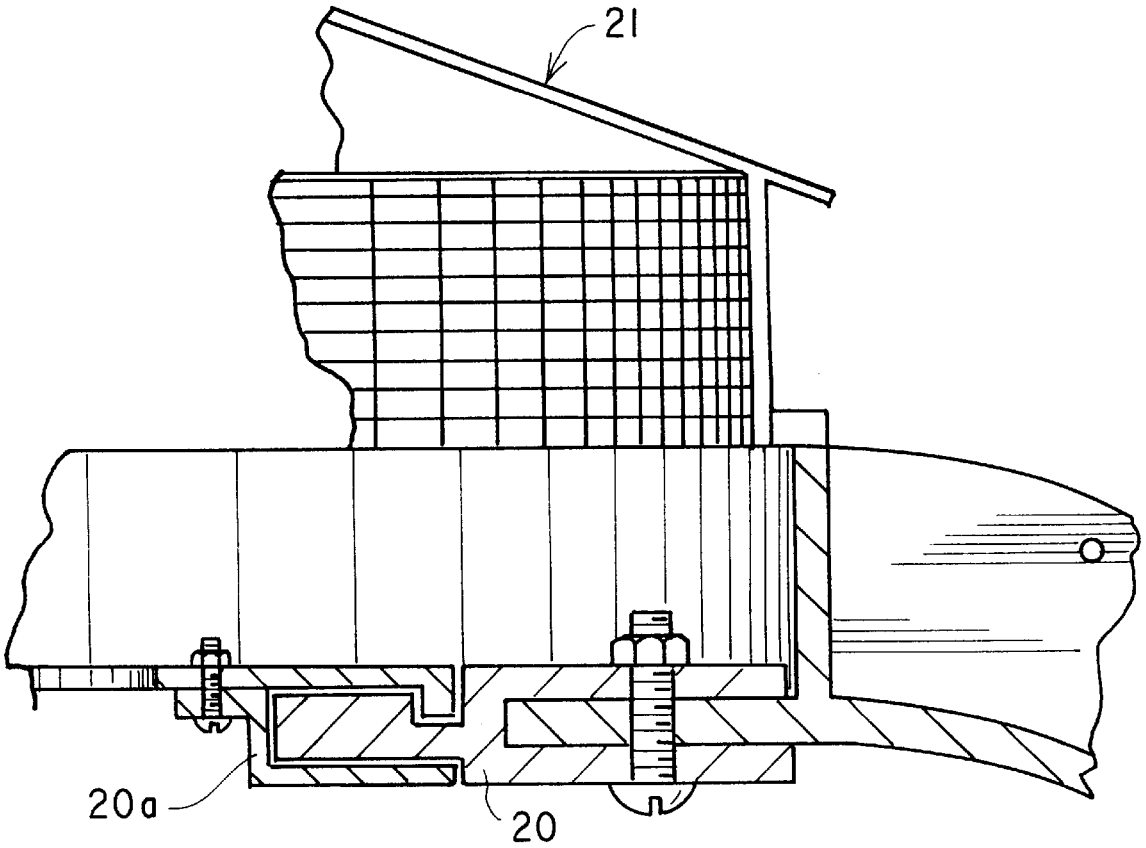
FIG. 5 is a sectional perspective view of the internal ring assembly and framework of the child's play shelter according to the invention.
Figure 6:
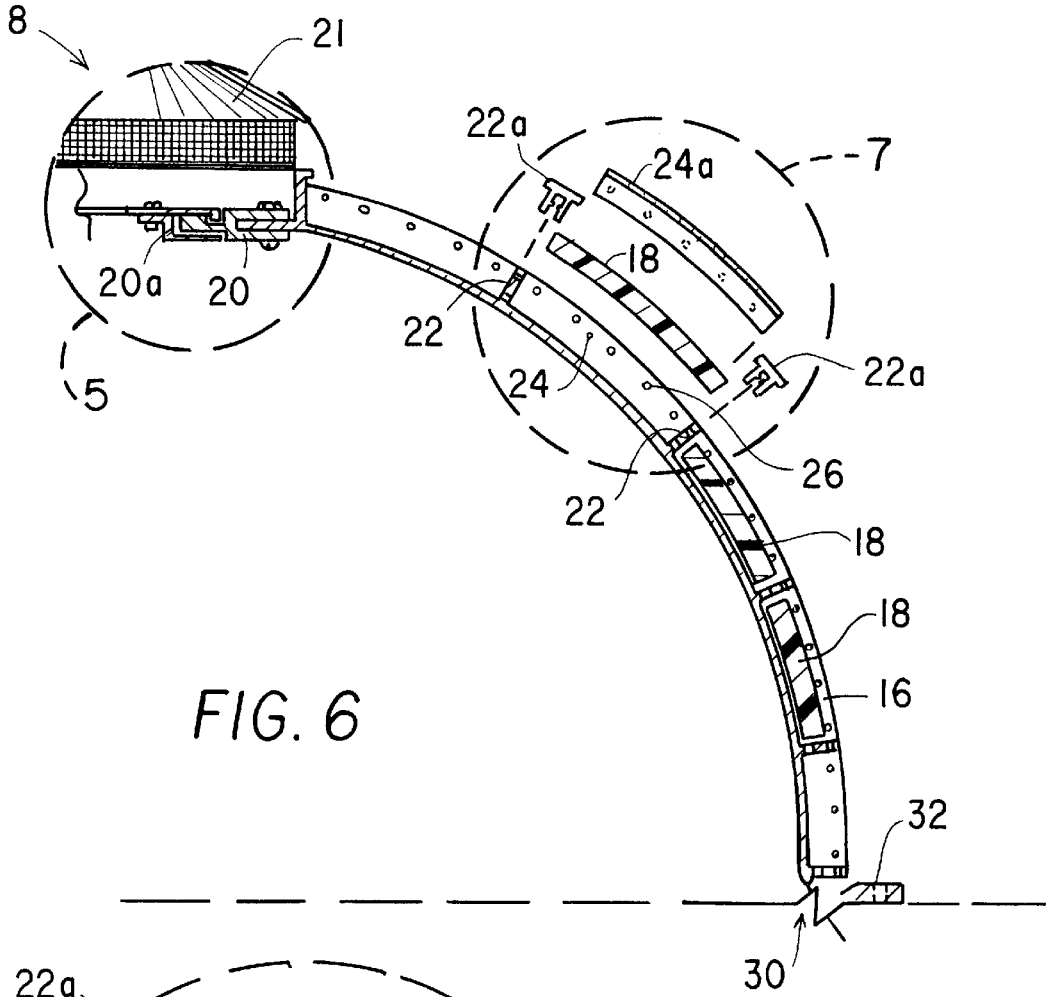
FIG. 6 is a perspective view in cross section of the horizontal and vertical T-bars and respective rib and panels, illustrating by an exploded view the interstitial plastic elements of the child's play shelter according to the invention.
Figure 7:
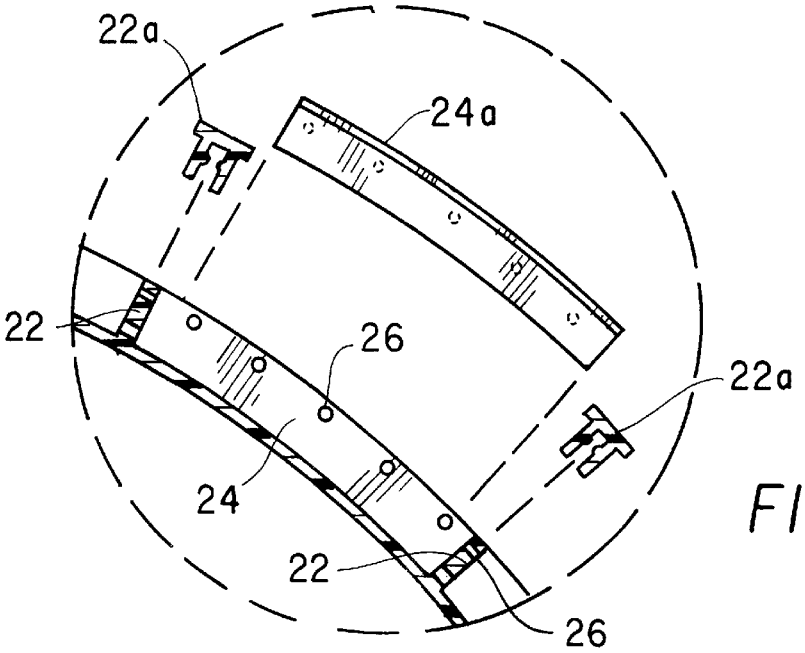
FIG. 7 is an exploded view in cross section of the horizontal and vertical T-bars and respective rib and panels according to the invention.

A plurality of cavities 16 are defined by the arcuate waffle-like structure 14 for receiving snow and/or interstitial styro-foam material or panels 18 which serve as building blocks as illustrated in FIG. 6. The framework 10 and top edge of each panel 18 converges and are fastened to a retaining ring 20 as schematically illustrated in FIG. 5. The ring 20 provides an opening for ventilation and permits the use of various accessories. A movable or rotating inner ring 20*a* mechanically fastened to the retaining ring 20 allows for mounted accessories such as a machine-gun, telescope, or periscope that rotates 360°. Alternative accessories include toy weapons and devices such as cannons, mounted rifles or machine guns, missile launchers, and satellite communication equipment, respectively. The opening can be optionally closed by a hinged rain cap or roof 21 of clear plastic similar to an army tank lid, for example. The cap or roof 21 can be conical in shape, and can include additional features such as a flag F, antennas, etc. Depending on the interest of the children, the igloo according to the instant invention is easily adapted for a particular occasion or play setting.

The waffle-like structure 14 is attached to the framework 10 by mechanical means (i.e. snap-on button fasteners, inserts or by nuts and bolts). Snap-on button fasteners have the advantage of being easily fastened and adjusted without the need for special tools. In this regard, these particular fasteners can be fastened directly onto the framework 10 or the respective waffle structure 14 (not shown). It would be obvious to one of ordinary skill in the art to provide the appropriate mechanical fastener or combination thereof to ensure a stable structure with the structural rigidity and flexibility so desired. Such features would require only routine skill in the art to provide.

Figure 2:
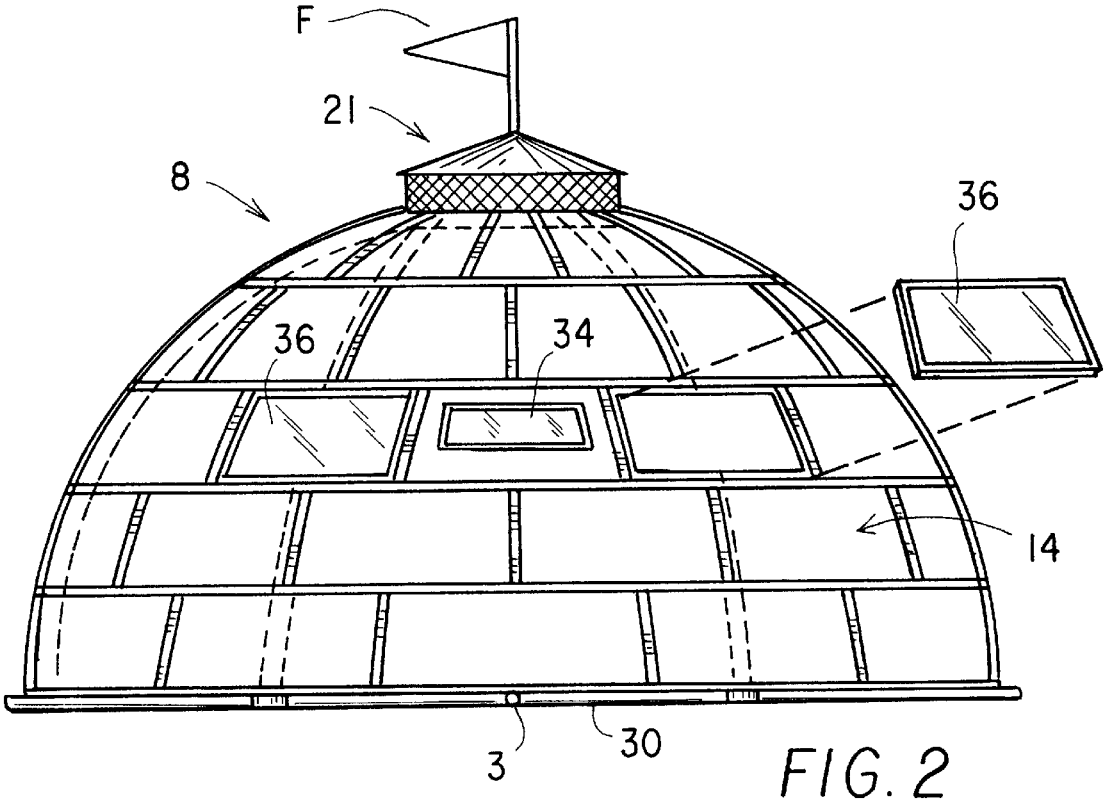
FIG. 2 is an environmental, perspective view of the child's play shelter according to the invention, illustrating pop-out windows.
Figure 4:
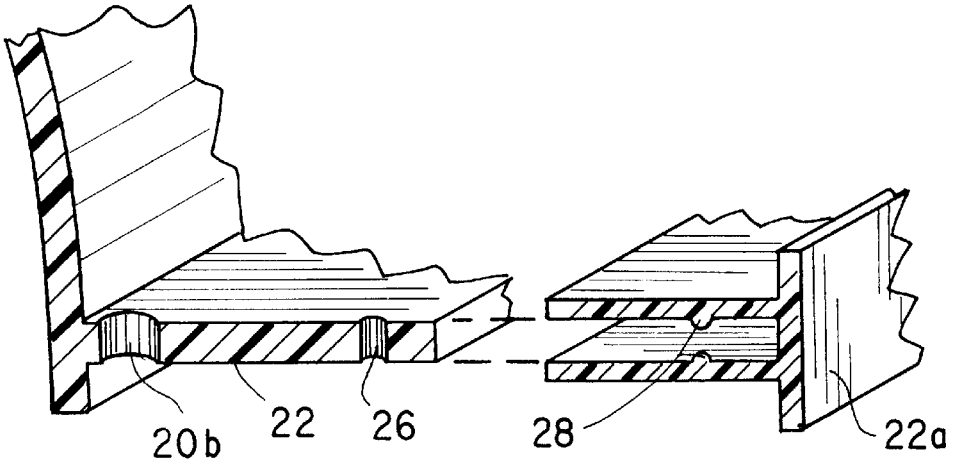
FIG. 4 is a cross-sectional view of a panel rib and T-bar strip attachment according to the invention.

The arcuate waffle structure 14 is better viewed in cross section as diagrammatically illustrated in FIG. 6. The waffle structure 14 is formed by a number of horizontal and vertical ribs 22 and 24 with respective holes 26. Snap-on horizontal and vertical arcuate T-bars 22*a* and 24*a* (about ¾" wide), respectively attach to the respective ribs 22 and 24, and are insertably and releasably fixed thereto. Prefabricated holes 26 are arranged within the respective ribs 22 and 24 for receiving and retaining nodules 28 formed within the respective T-bars 22*a* and 24*b*. As shown in FIG. 4, a trough or channel 20*b* is formed in each respective horizontal rib 22 which provide a means for carrying melted snow or rain water down and away from the igloo 8 via an exit channel 3 as indicated in FIG. 2. The T-bar and panel ribs increase in area in sections from the base 30 of the igloo 8 in ascending order towards the retaining ring 20 as diagrammatically illustrated FIG. 6.

The ring 20 defines a circular opening centrally defined in and through the arcuate waffle-like housing structure 14 which is circumferenced thereabout to define a structurally sound framed igloo-like play shelter 8. The bottom or base 30 of the child's play shelter 8 has the optional feature of anchor lugs 32 for fastening the igloo 8 to a platform (not shown). The anchor lugs 32 are pre-fabricated and are fastended to the bowed framing members 12 at the base of the igloo. The lugs 32 are disposed either at the bottom ends of each framing member 12 or as separate elements. In addition, the anchor lugs 32 (as separate elements) can be adapted for attachment to the bottom of the framing members 12 and a platform or supporting surface by mechanical fasteners such as nuts and bolts or by stakes depending on the nature of the supporting platform.

As shown in FIG. 2, pop-out windows 34 and 36 are disposed within the arcuate waffle-like structure 14 which simply rests on precast lips in the panels 18 of the structure 14. The respective windows are made to be installed from outside the igloo 8. Besides providing illumination, the windows would provide a means by which an adult could monitor the children, and to pop-out the windows to provide an emergency exit. The windows 36 have a larger surface area for emergency exits, while the windows 34 are smaller in surface area for inserting toy guns and other weapons according to a specific play setting. Other options include the use of replacement screens (not shown) which would allow ventilation in a camping setting for example. In addition, an optional overhead visor above each window would protect the window portals from water entry due to rain storms or simulations thereof via normal garden hoses. The windows 34 and 36 are curved or arcuate in shape to conform to the contour and shape of the igloo 8.

Figure 3:
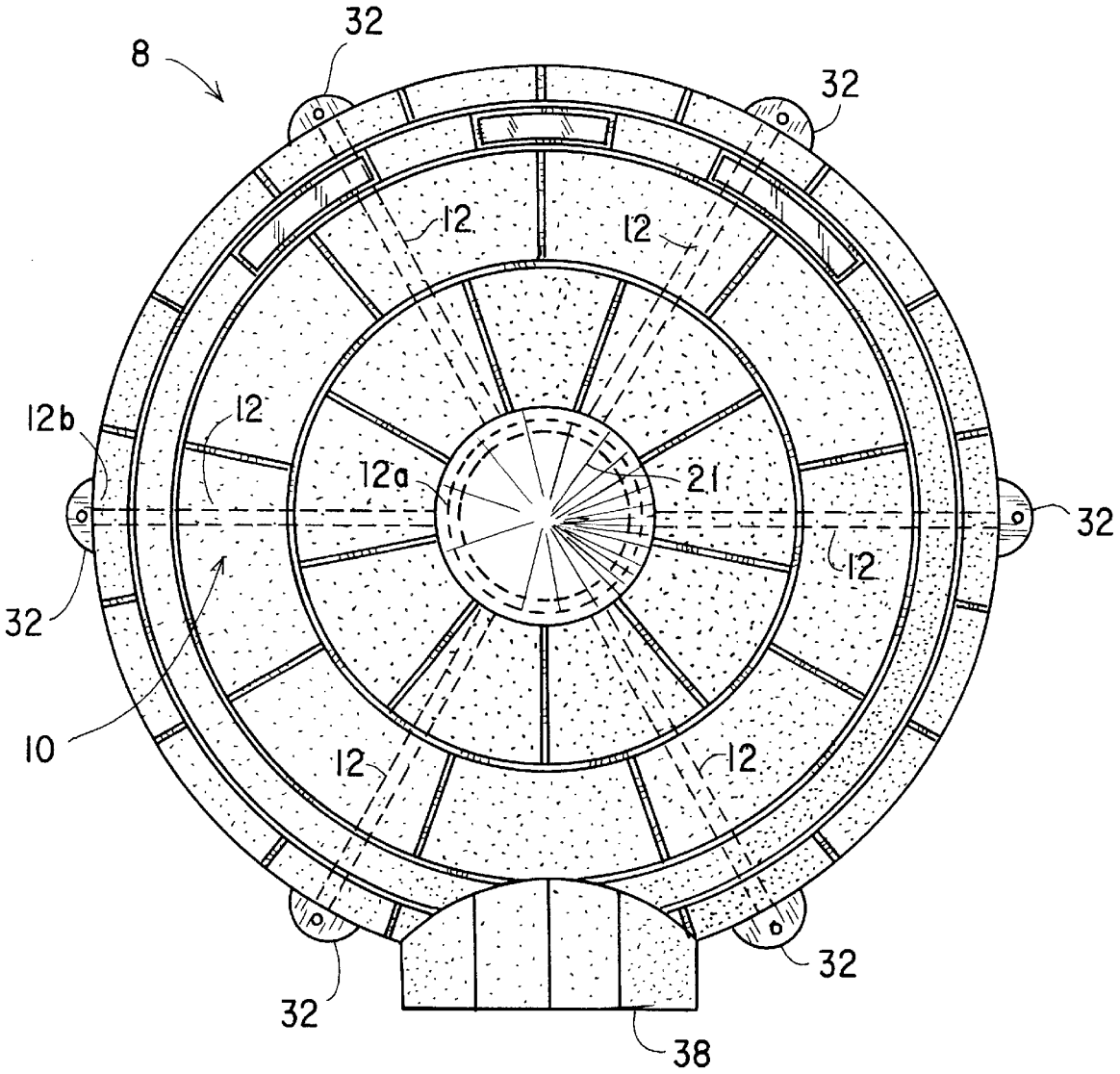
FIG. 3 is a top view of FIG. 1 according to the present invention.

A crawl-in-entrance way 38 is disposed within a wall of the play shelter 8 as diagrammatically illustrated in FIGS. 1 and 3. The waffle-like housing structure 14 is preferably made of a flexible material such as composite plastic material. Each of the bowed framing members 12 are preferably rubber coated metal. This special coating protects children from potential impact or contact injuries from bare metal. In other words, this will protect a child's skin or tongue from seizing it in extremely cold temperatures.

As diagrammatically illustrated in FIG. 3, anchor lugs 32 protrude from the bottom or base 30 of each framing member 12 for attachment to a supporting platform. Other options featured in the instant invention include the use of a mesh flap which opens outwardly over the entrance to prevent small animals or insects from entering the shelter 8. An instrument panel can also be included on an interior wall of the igloo 8 in the form of a painting or chart comprising a steering wheel or lever. Also, inside the igloo 8 a 2" water resistant insulated mat can be used to provide some comfort and act as a barrier from the damp or cold ground.

A lighted, battery operated instrument console accessory could be mounted over the painted instrument panel or cluster providing even greater realism as well. The charts could depict distances and headings between airports, solar planets, desert strongholds, and water holes, etc. The interstitial panels 18 can also be painted in very unique designs according to personal preference. For example, the panels can be painted in camouflage or can be painted to resemble a favorite cartoon character such as. The various uses of the child's play shelter are numerous, and limited only to ones imagination. Other possible uses include a space craft, bomber turret, ranger observation post, pillbox, Military bunker, field hospital, castle, calvary fort, cowboy's cabin, bomb shelter, and observatory.

It is to be understood that the present invention is not limited to the embodiments described above, but encompasses any and all embodiments within the scope of the following claims.

I claim:

1. A child's play shelter in the form of an igloo-like structure, comprising:

an interior-supporting framework made up of a plurality of equispaced, bowed framing members arranged to generally form a hemisphere, said bowed members having upper ends and lower ends, each of said bowed members being formed of rubber coated metal;

an exterior, precast, arcuate waffle-like housing structure, dimensioned and configured to fit over and be supported by said framework, said housing structure having a plurality of cavities arranged in rows, each of said cavities containing a panel that collectively serve as building blocks, each said panel being retained by horizontal and verticaL ribs with holes, there further being an upper circular opening centrally defined in and through said housing structure; and a ring joining together the top ends of said bowed framing members and said housing structure at said upper circular opening thereof.

2. The child's play shelter in the form of an igloo-like structure as claimed in claim 1, said framing member bottom ends each further including an anchor lug for securing each of said framing members to a supporting surface.

3. The child's play shelter in the form of an igloo-like structure as claimed in claim 1, wherein said ring is a rotatable ring.

4. The child's play shelter in the form of an igloo-like structure as claimed in claim 1, wherein said rotatable ring further comprises an inverted conical cap attached thereto.

5. The child's play shelter in the form of an igloo-like structure as claimed in claim 1, wherein said ring is joined together said top ends and bowed members by mechanical fasteners.

6. The child's play shelter in the form of an igloo-like structure as claimed in claim 5, wherein said mechanical fasteners are nuts and bolts.

7. The child's play shelter in the form of an igloo-like structure as claimed in claim 1, further comprising a crawl-in entrance way.

8. The child's play shelter in the form of an igloo-like structure as claimed in claim 1, further comprising pop-out windows.

9. A child's play shelter in the form of an igloo-like structure, comprising:

an interior-supporting framework made up of a plurality of equispaced, bowed framing members arranged to generally form a hemisphere said bowed members having upper ends and lower ends;

an exterior, precast, arcuate waffle-like housing structure made of a flexible composite plastic material, said housing structure being dimensioned and configured to fit over and be supported by said framework, said housing structure having a plurality of cavities arranged in rows, each of said cavities containing a panel that collectively serve as building blocks, each said panel being retained by horizontal and vertical ribs with holes, there further being an upper circular opening centrally defined in and through said housing structure;

snap-on T-bars attachable to said ribs for securing said panels within said cavities; and a ring Joining together the top ends of said bowed framing members and said housing structure at said upper circular opening thereof.

10. A child's play shelter in the form of an igloo-like structure, comprising:

an interior-supporting framework made up of a plurality of equispaced, bowed framing members arranged to generally form a hemisphere, said bowed members having upper ends and lower ends;

an exterior, precast, arcuate waffle-like housing structure made of a flexible rubber coated metallic material, said housing structure being dimensioned and configured to fit over and be supported by said framework, said housing structure having a plurality of cavities arranged in rows, each of said cavities containing a panel that collectively serve as building blocks, each said panel being retained by horizontal and vertical ribs with holes, there further being an upper circular opening centrally defined in and through said housing structure;

snap-on T-bars attachable to said ribs for securing said panels within said cavities; and a ring joining together the top ends of said bowed framing members and said housing structure at said upper circular opening thereof.

* * * * *